US009036854B2

(12) United States Patent
Lewis

(10) Patent No.: US 9,036,854 B2
(45) Date of Patent: May 19, 2015

(54) AUDIO EQUIPMENT ATTACHABLE TO SPECTACLES

(76) Inventor: Marcus Lewis, Ross-on-Wye (GB)

( * ) Notice: Subject to any disclaimer, the term of this patent is extended or adjusted under 35 U.S.C. 154(b) by 1235 days.

(21) Appl. No.: 11/920,327

(22) PCT Filed: May 9, 2006

(86) PCT No.: PCT/GB2006/001669

§ 371 (c)(1),
(2), (4) Date: Sep. 15, 2008

(87) PCT Pub. No.: WO2006/120416

PCT Pub. Date: Nov. 16, 2006

(65) Prior Publication Data

US 2009/0097688 A1 Apr. 16, 2009

(30) Foreign Application Priority Data

May 10, 2005 (GB) ..... 0509468.5

(51) Int. Cl.
*H04R 25/00* (2006.01)
*H04R 5/02* (2006.01)

(52) U.S. Cl.
CPC ..... *H04R 5/023* (2013.01)

(58) Field of Classification Search
USPC ..... 381/309, 327, 330, 370, 374, 381
See application file for complete search history.

(56) References Cited

U.S. PATENT DOCUMENTS

| | | | | |
|---|---|---|---|---|
| 2,856,466 | A | 10/1958 | Gustafson et al. | |
| 4,856,086 | A | 8/1989 | McCullough | |
| 5,159,639 | A * | 10/1992 | Shannon et al. | 381/327 |
| 5,606,743 | A * | 2/1997 | Vogt et al. | 455/347 |
| 5,706,360 | A | 1/1998 | Khandekar | |
| 5,715,323 | A | 2/1998 | Walker | |
| 5,835,185 | A * | 11/1998 | Kallman et al. | 351/113 |
| 2002/0197961 | A1 | 12/2002 | Warren | |
| 2004/0157649 | A1 * | 8/2004 | Jannard et al. | 455/569.1 |

FOREIGN PATENT DOCUMENTS

| | | | |
|---|---|---|---|
| DE | 19624184 | | 1/1998 |
| GB | 2272073 | | 5/1994 |
| WO | WO2004/012477 | | 2/2004 |
| WO | WO 2004012477 | A2 * | 2/2004 |
| WO | WO2006055884 | | 5/2006 |
| WO | WO 2006055884 | A2 * | 5/2006 |
| WO | WO2006079254 | | 8/2006 |

* cited by examiner

*Primary Examiner* — Tsz Chan
(74) *Attorney, Agent, or Firm* — Skinner and Associates; Joel Skinner

(57) ABSTRACT

Audio equipment comprising a signal generating module (26) arranged to output signals to a pair of speakers (20), wherein the speakers (20) are mounted upon respective housings (18), adapted to be carried by a glasses frame unit (30).

7 Claims, 5 Drawing Sheets

AUDIO EQUIPMENT ATTACHABLE TO SPECTACLES

This invention relates to audio equipment, and in particular to personal audio equipment, for example to allow the user to use mobile communications equipments, listen to radio transmissions, MP3 or other audio data files, or the like.

People often wish to use mobile communications equipment, for example cellular telephones, or listen to music or the radio using personal audio equipment. However, for people who wear glasses or sunglasses, the headphones or ear pieces of the audio equipment or the earpieces of hands free cellular telephone equipment often interfere with the earpieces or temples of the glasses with the result that it is uncomfortable for the audio or hands free equipment to be used whilst wearing glasses, for example because the headphones tend to push the earpieces or temples of the glasses inwardly against the sides of the user's head.

It is an object of the invention to provide audio equipment suitable for use in such circumstances.

According to the present invention there is provided audio equipment comprising a signal generating module arranged to output signals to a pair of speakers, wherein the speakers are mounted upon respective housings, one of the housings containing a power supply unit, and the other housing containing at least part of the signal generating module, the housings being arranged to be carried by a glasses frame.

The housings may be electrically connected to one another by a strap, which may also serve as a safety strap to reduce the risk of loss or damage to the audio equipment.

Alternatively, the housings may be electrically connected to one another by wires passing across the face of the glasses frame.

The housings conveniently define support regions which may be adapted to be worn over and/or behind the ear.

Such a design is advantageous in that the user can wear his glasses in substantially the usual manner, the arms/earpieces of the glasses resting upon the support regions of the housings rather than directly upon the ears. The speakers are not pushed against the sides of the user's head and so the audio equipment is of improved comfort.

Alternatively, the support region may be adapted to allow the associated housing to be carried by, for example, an arm or earpiece of a pair of glasses. In such an arrangement, the glasses would be worn normally.

The module could comprise, for example, a radio receiver or an MP3 player. The radio receiver may be adapted to receive signals transmitted from a transmitter device connectable to another audio device, for example a cellular telephone, a compact disc player, an MP3 or other data file player or the like. Where the audio equipment is to be used with a cellular telephone or other mobile communications equipment, then the audio equipment preferably further comprises a microphone. The microphone could be located, for example, in the module. Further, the module may include a transmitter to transmit the signals to, for example, the mobile telephone.

One significant advantage of the invention is that the glasses are electrically inert, other than when in use with the audio equipment as they do not have their own internal power supply.

The housings are conveniently provided with locator means to locate the glasses relative to the housings. For example, the housings may be designed to incorporate a groove or channel adapted to receive an arm/earpiece of the glasses to locate the glasses relative to the housings. Alternatively, each housing may be provided with an upstanding flange against which the arms/earpieces of the glasses engage to locate the glasses relative to the housings. A further alternative is to provide the housings with upstanding formations engageable with corresponding formations provided in the arms/earpieces to locate the glasses relative to the housings.

Where the electrical connection between the housings is made by way of wires passing across the face of the glasses, each housing is conveniently provided with connector means adapted to connect to corresponding connector means provided on the adjacent parts of the temples of the glasses. In one embodiment, at least some of the connector means comprise electrical contacts resiliently biassed towards an extended position. The resilient biassing may be achieved using, for example, a pad of an elastomeric material.

According to another aspect of the invention there is provided audio equipment comprising first and second housings supporting respective speakers and securable to a glasses frame, and electrical connection means providing electrical connections being circuits provided within the housings and components provided in the glasses frame.

The components could comprise at least part of a signal generating module. Alternatively, or additionally, they may comprise wires or conductors to provide an electrical connection between the housings. It will be appreciated that in such an arrangement, removal of the housings from the glasses frame may render the glasses frame electrically inert.

The invention will further be described, by way of example, with reference to the accompanying drawings, in which.

Figure 1:
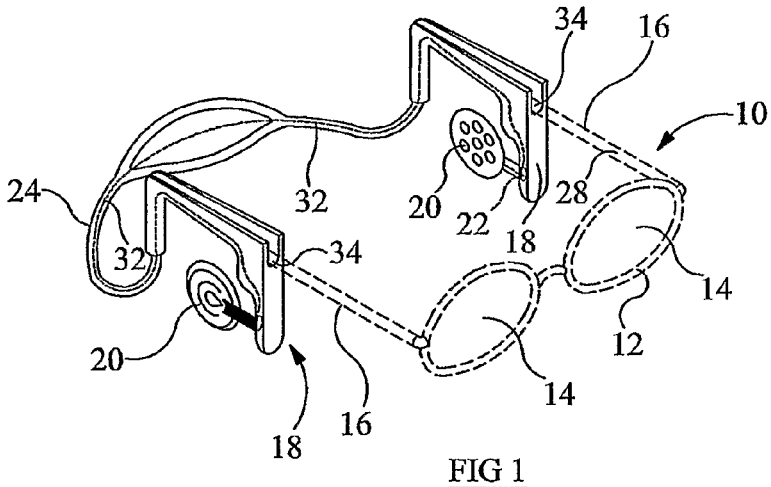
FIG. 1 is a perspective view of audio equipment in accordance with one embodiment of the invention.

The audio equipment illustrated in FIG. 1 is intended for use with a pair of glasses or sunglasses. The glasses/sunglasses may be of generally conventional form, but modified or designed specifically to work with the audio equipment.

A typical pair of glasses or sunglasses comprises a frame 10 having a face 12 supporting lenses 14. The lenses 14 may, depending upon the intended use of the glasses/sunglasses, be designed to correct for visual impairments such as short sightedness or long sightedness and/or to carry a coloured tint (either for aesthetic reasons or to reduce the amount of light passing through the lenses so as to allow the glasses to function as sunglasses) and/or to filter harmful ultraviolet rays from the light incident thereon. The face 12 is provided with formations defining hinges to which temples 16 are connected. The temples extend rearwardly from the face 12 and are arranged to pass over and behind the user's ears, in use.

Rimless frames are also known in which the lenses are carried directly by the temples, and the invention is also applicable to such designs of glasses, and to other designs of glasses.

The audio equipment of this embodiment of the invention comprises a pair of housings 18, each of which is adapted to carry a speaker 20. A ball and socket type mounting 22 is provided to connect each speaker 20 to the associated housing 18 to allow the speakers 20 to be moved relative to the housings 18. The use of a ball and socket joint also allows the component parts to be non-landed, simplifying manufacture. The speakers 20 are of fairly small dimensions and, although intended to be used whilst floating immediately adjacent the user's ear canal entrances, they could, if desired, be used as in-ear speakers.

The housings 18 are interconnected by a strap 24. The strap 24 is of hollow, tubular form and wires or leads 32 are provided to allow a signal to pass from one of the housings 18 to the other. The strap 24 may be of a wide range of materials, for example leather, fabric, metal links, a braid, for example braided cable, or an elastomeric material.

As illustrated in the accompanying drawings, the upper parts of the housings 18 form support regions which are shaped to include upstanding flanges between which are defined grooves or channels 34 intended to receive parts of the temples 16 of the glasses.

There is a desire to provide glasses or sunglasses in which, for example, a radio receiver is provided to allow the user to listen to the radio or other transmitted signals whilst wearing the glasses. The transmitted signals may include signals transmitted by devices attached to, for example, the outputs of cellular telephone or other mobile communications devices, CD players, MP3 or other data file players, or a range of other devices, including audio messaging devices. In order to hear a stereo signal, the signal must be supplied to both earpieces of the glasses, and conventional arrangements would require wiring to pass across the front of the glasses to supply signals to both speakers. This embodiment of the invention allows a user to listen to, for example, the radio or other transmitted signals without such design constraints being placed upon the design of the glasses, the signal carrying wires or leads 32 passing through the strap 24 behind the user's neck or head rather than through the front of the frame 10 across the front of the user's face.

Figure 2:
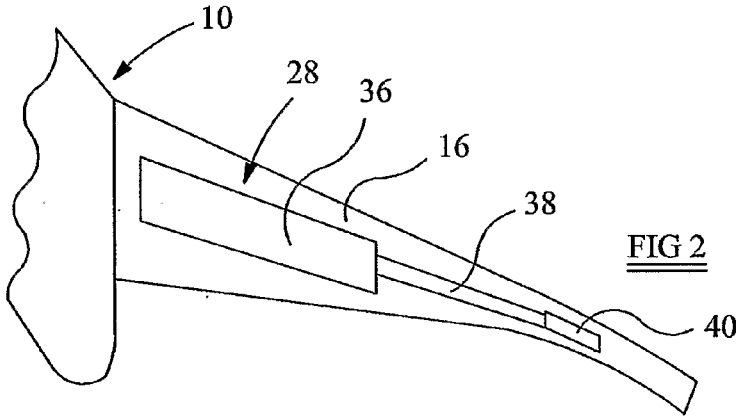
FIG. 2 is a diagram illustrating part of some glasses intended for use with the invention.

As shown in FIG. 2, the glasses are designed to incorporate a radio receiver 36. The receiver 36 conveniently comprises a small circuit board carrying suitable circuits and which may be located in or on, for example, one of the temples 16 adjacent the user's temple, in use. Electrical conductors 38 are conveniently provided in the temple 16 in which the receiver 36 is located, the conductors 38 terminating at terminal plates 40 located on opposing sides of the temple 16 (see FIG. 3) in a location received, in use, in the channel 34 of one of the housings 18. The housing 18 is provided with contacts 42 arranged to engage the terminal plates 40, in use, to connect the receiver 36 to circuits located within the housing 18, the wires 32 located in the strap 24 connecting the other housing 18 to the radio receiver 36. The other housing 18 houses a power supply unit used to supply electrical power, through the said one of the housings 18 to the receiver 36. It will be appreciated that, in this embodiment, the circuits located in the housing 18, in conjunction with the receiver 36 form the signal generating module of the invention.

The signal generating module 28 may take a wide range of forms. By way of example, it may comprise a small radio receiver or an MP3 or other audio data file player. A further possibility is for the signal generating module 28 to incorporate a Bluetooth type transmitter/receiver to allow, for example, mobile telephone calls to be held using the audio equipment. A further possibility is for the module to receive signals transmitted from an auxiliary transmitter device to be fitted to, for example, a mobile telephone, an MP3 player, a CD player or the like. This is thought to be advantageous as the signal may be transmitted at a frequency well below microwave frequencies, and therefore is thought not to be harmful to parts of the human body located close to the receiver.

Where used with a mobile communications device, for example a cellular telephone, then the receiver 36 conveniently also incorporates a microphone and serves as a transmitter, arranged to transmit signals from the microphone to be received by the mobile communications device.

In use, the user puts on the audio equipment, locating the housings 18 over and behind his ears with the speakers 20 located adjacent his ears so as to be able to hear sounds produced thereby. The strap 24 passes behind the user's head or neck. The user can then wear his glasses/sunglasses in substantially the usual manner, locating the temples 16 of the glasses in the channels 34 of the housings 18 rather than having the temples resting directly upon his ears. The co-operation between the housings 18 and the temples 16 of the glasses serve to locate and firmly hold the glasses in position, and maintain the electrical contact between the housings 18 and the glasses.

The housings 18 are conveniently of an elastomeric material, and the channels 34 thereof are conveniently slightly smaller in width than the temples 16 of the glasses with the result that the temples 16 are gripped by the housings 18. It will be appreciated, therefore, that the strap 24 can serve as a safety strap for the glasses.

Figure 3:
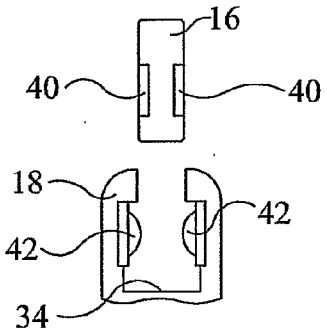
FIGS. 3 and 4 illustrate ways of providing an electrical connection between the equipment and the pair of glasses.
Figure 4:
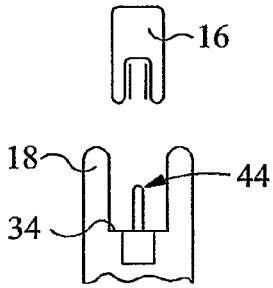
Figure 6:
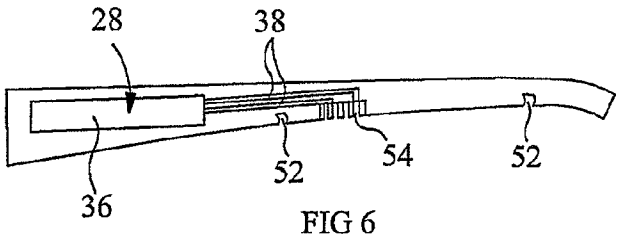
FIG. 6 is a view of part of the pair of glasses used in the embodiment of FIG. 5.
Figure 5:
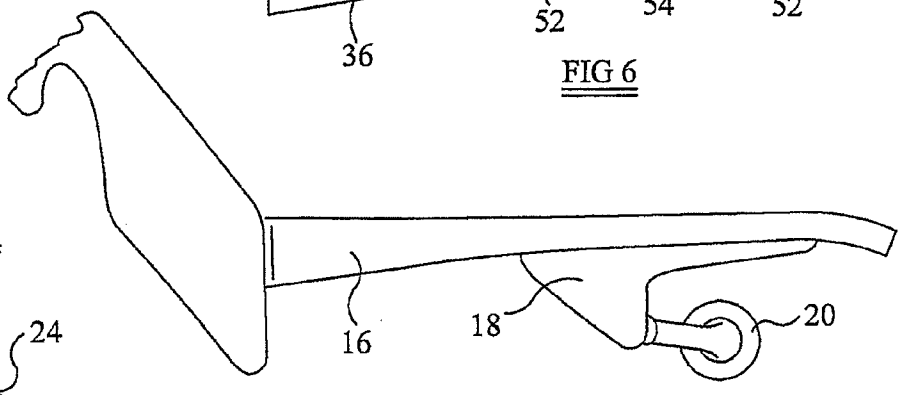
FIG. 5 is a view illustrating an alternative embodiment of the invention, in use.

Rather than use the connection arrangement shown in FIGS. 2 and 3, a simple plug and socket arrangement 44 could be used, as shown in FIG. 4, to provide an electrical connection between the receiver 36 or other signal generating module and the speakers 20.

In the embodiments described hereinbefore, the power supply unit is conveniently in the form of rechargeable batteries located in one of the housings 18. It may be desirable to provide a dock into which the equipment may be fitted to allow charging of the batteries. Where an MP3 player or other audio data file player is incorporated into the equipment, the dock may also serve to allow data files to be downloaded into the player.

Rather than provide each housing with a pair of flanges defining a groove serving to locate the earpieces or arms of the glasses relative to the housings, each housing may incorporate a single upstanding flange arranged, in use, to lie adjacent an associated one of the temples to locate the glasses, laterally, relative to the housings. Obviously, where the temples engage against a single flange rather than being located within a groove or channel defined between a pair of flanges, alternative electrical connection arrangements may be required to electrically connect the circuits contained within the housings and the power supply unit to the module, and other means may be required to secure the housings to the glasses.

FIGS. 5 to 9 illustrate an alternative arrangement in which the housings 18 are not provided with flanges to locate the arms or earpieces of the glasses, but rather the housings 18 are provided with upstanding locating projections 50 receivable within corresponding recesses 52 provided in the arms or earpieces 16 of the glasses. One of the temples 16 and the associated one of the housings 18 are further provided with an electrical connector arrangement 54 to provide an electrical connection between the receiver module 36 carried by the said one of the temples 16 of the glasses and circuits located within the associated one of the housings 18 to allow electrical power from the power supply unit to be transmitted to the receiver module 36 and to allow the output signal from the receiver module 36 to pass to the said one of the housings 18. The lead 32 is used to transmit the appropriate output signal to the other one of the housings 18 and associated speaker 20.

Figure 9:
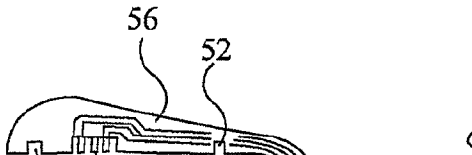
FIG. 9 is a view illustrating part of the audio equipment in the mode of operation shown in FIG. 8.
Figure 7:
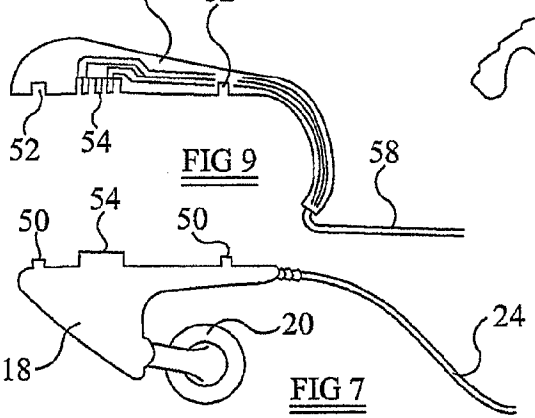
FIG. 7 is a view of part of the audio equipment of the embodiment of FIG. 5.
Figure 8:
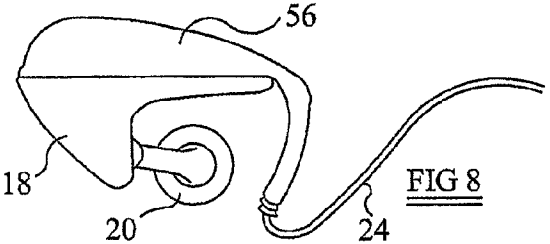
FIG. 8 is a view illustrating the audio equipment of the embodiment of FIG. 5 in another mode of operation.
Figure 10:
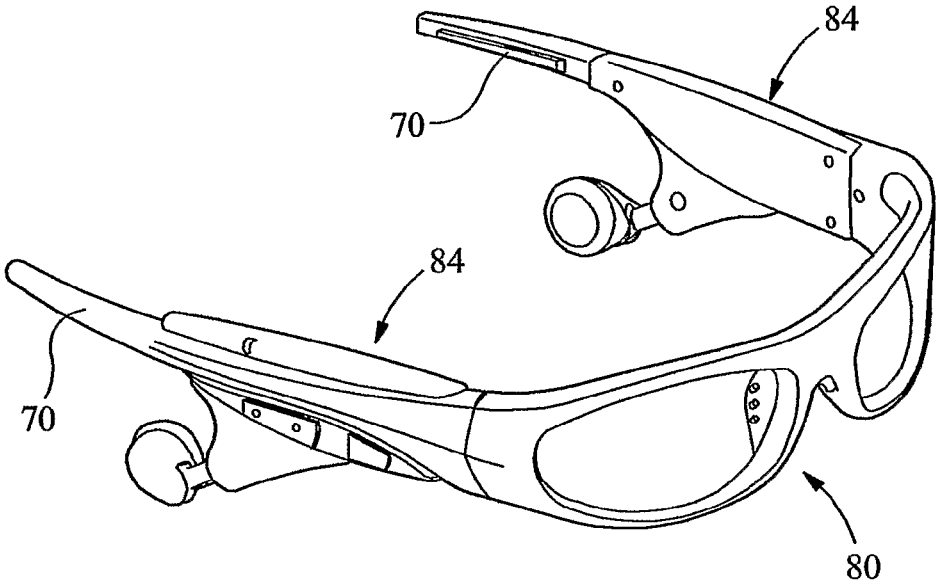
FIGS. 10 to 13 illustrate a further embodiment of the invention.

As shown in FIGS. 8 and 9, when not in use with the glasses, an auxiliary housing 56 may be connected to the said one of the housings 18 to supply an audio signal thereto. The housing 56 may be connected through a lead 58 to a signal generating module, for example similar to the receiver module 36, which could be carried by the strap 24 or located elsewhere. A similar, dummy, housing may be connectable to the other one of the housings 18 for aesthetic purposes.

Figure 11:
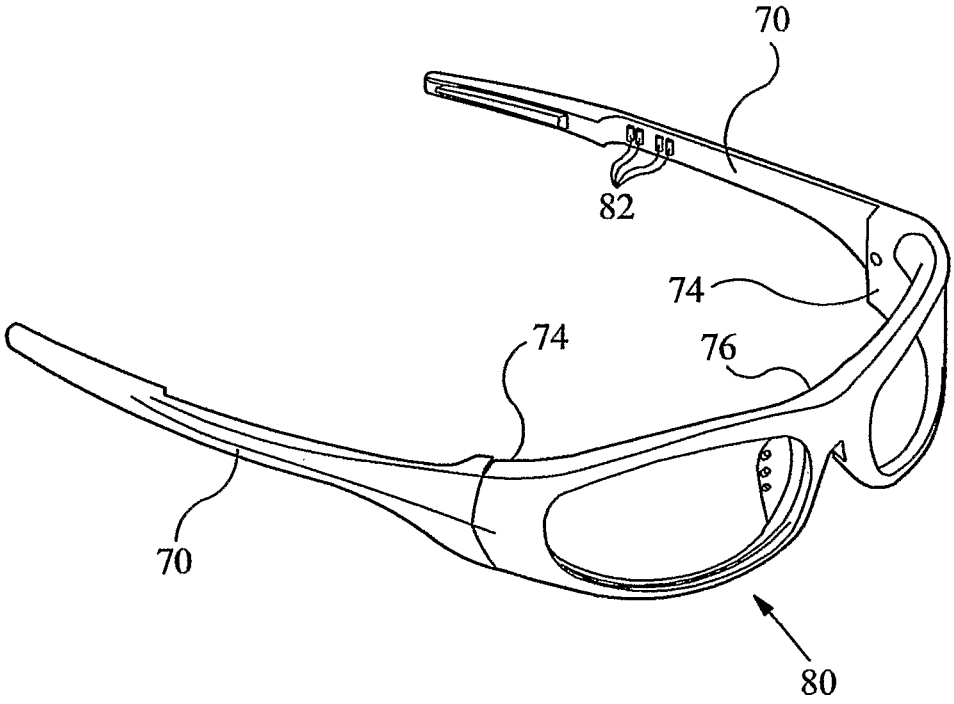
Figure 12:
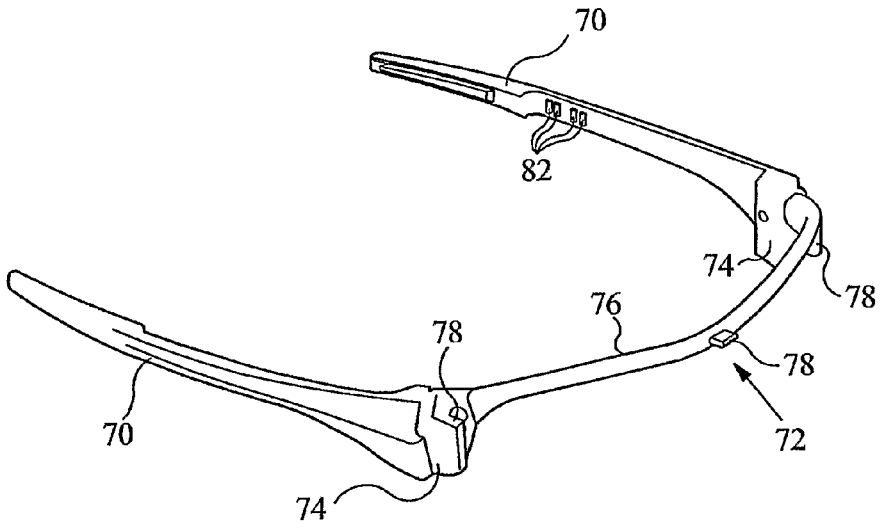
Figure 13:
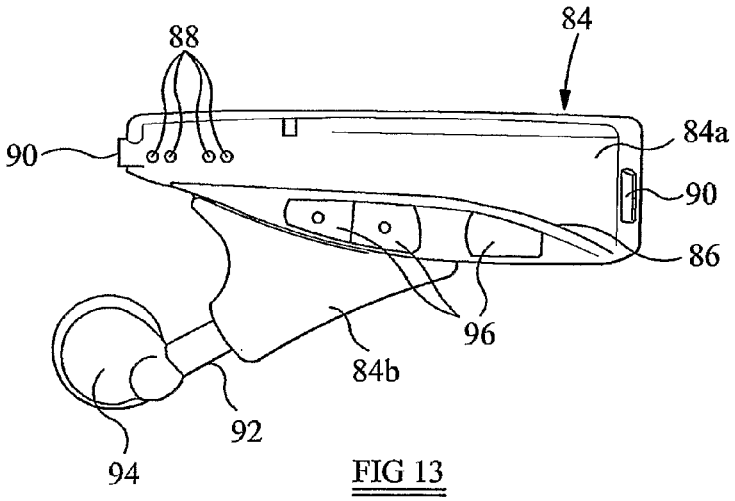

FIGS. 10 to 13 illustrate another embodiment of the invention. In this arrangement, rather than using cables located within a neck strap to transit power and signals between the two housings, wires or conductors provided in the glasses are used to provide this function. FIG. 11 illustrates a frame of a pair of sunglasses which comprise a pair of temples 70 connected by hinges to a face assembly 72 (see FIG. 12). The face assembly 72 comprises a pair of face supports 74, each being hinged to a respective one of the temples 70, the face supports 74 being interconnected by a connection bar 76. The centre part of the connection bar 76 and each of the face supports 74 are provided with formations 78 to which a face component 80 can be secured, the face component 80 defining rims supporting a pair of lenses, and also including pads to bear against a wearer's nose, in use. The design is such that, if desired, the face component 80 can be interchanged thus allowing a number of frame styles to be provided, all using a common design of temples, face support and connection bar.

The temples 70, face supports 74 and connection bar 76 all carry, internally, wires or other electrical conductors to allow electrical power and signals to be passed between connection pads 82 provided on one of the temples 70 and corresponding pads 82 provided on the other of the temples 70. The pads 82 comprise elements of an electrically conductive material mounted upon a block of an elastomeric material, the elements being electrically connected to corresponding ones of the wires or conductors mentioned hereinbefore. The elastomeric material applies a resilient biassing force to the pads 82.

Securable to each temple 70 is a housing 84. Each housing 84 comprises an upper part 84*a* defining a ledge 86 against which part of the associated temple 70 rests, the housing 84 containing a circuit board or circuit boards. The circuits provided on the circuit board(s) are connected, in use, to the wires or conductors by means of pins 88. The pins 88 engage against the pads 82, the resilient biassing provided by the elastomeric material maintaining the electrical contact.

The housings 84 are conveniently securable to the respective temples 70 by formations 90 provided on the housings 84 engageable with corresponding formations provided on the temples 70. At least one of the formations is conveniently movable to allow release of the housing 84 from the associated temple 70. As illustrated, the temples are conveniently provided with recesses to accommodate the housings 84. The provision of the recesses improves the appearance of the equipment and also serves to positively locate the housing 84, in use.

Slidably connected to a lower part of the housing part 84*a* is a lower housing part 84*b* from which extends a speaker stem 92 on which a speaker 94 is mounted, the speaker 94 being connected by cables extending through the stem 92 to the circuit board provided within the housing 84. The slidable connection of the lower housing part 84*b* permits the position of the speaker 94 in the fore-aft direction to be adjusted to suit the wearer. The connection of the stem 92 to the speaker 94 is conveniently through a ball and socket joint to allow further adjustment of the speaker position. The ball and socket joint may further be designed to telescope to allow further adjustment and may be designed to allow limited angular movement of the stem about its axis.

The circuit board provided in one end of the housings 84 contains a power supply unit for example in the form of a re-chargeable battery. The circuit board provided in the other of the housings serves as the signal generating module and may perform any of the functions described hereinbefore. This one of the housings 84 is conveniently formed with buttons 96 to allow a wearer to control the operation thereof.

It will be appreciated that the wires or conductors provided in the sunglasses serve to carry the signals from one of the housings 84 to the other to allow both speakers to function, and also to transmit power from the power supply unit to the signal generating module.

As with the arrangements described hereinbefore, when the housings 84 are disconnected from the sunglasses, the sunglasses are inert, both housings being required for the circuits to be operative. Further, as the face component can be interchanged, a wide variety of styles can be provided relatively easily.

The function of the buttons, and hence the numbers and positions thereof, will depend upon the nature of the signal generating module. For example, in some applications the buttons may control volume, bass/treble, whether the output is a mono or stereo output etc.

It will be appreciated that a large number of modifications and alterations may be made to the arrangements described hereinbefore within the scope of the invention, and that this application covers all such modifications and alterations. By way of example only, where the temples of the glasses are of tapering shape, the housings 18 could be formed with passages into which the arms can be inserted, the shaping of the passages co-operating with the arms to hold the glasses in the desired position relative to the housings 18, suitable electrical connectors being provided to transmit power and signals between the housing and the glasses. Once in use, the housings will not slip from the temples of the glasses as the user's ears will tend to prevent such movement. If desired, support members may be provided to allow use of the equipment when the glasses are not used. The support members may be designed to fit over and/or behind the user's ear and be adapted to plug into the passage of the associated housing. Conveniently, an elastomeric material is used in the manufacture of the housing and/or the support member. Of course, a range of other modifications and alterations are possible.

The invention claimed is:

1. Audio equipment comprising a glasses frame including a pair of temples, the glasses frame incorporating electrical conductors, a pair of housings which are readily and easily removably securable to the temples during use by the user without the use of tools, one of the housings containing a power supply unit and the other housing containing at least part of a signal generating module, the signal generating module being arranged to output signals to a pair of speakers, the speakers being mounted upon the housings, wherein when the housings are secured to the temples, the power supply unit and the signal generating module are electrically connected to the conductors thus permitting electrical power and signals to be transmitted between the housings by the conductors, manual removal of the housings from the temples by the user disconnecting the power supply unit and signal generating module from the conductors such that the glasses frame is electrically inert.

2. Equipment according to claim 1, wherein the housings define support regions adapted to allow the associated housing to be carried by the temple of the glasses frame.

3. Equipment according to claim 1, wherein the glasses frame has a removable face component.

4. Equipment according to claim 1, where the module comprises a radio receiver adapted to receive signals transmitted from a transmitter device connectable to another audio device.

5. Equipment according to claim 1, wherein the housings are provided with locator means to locate the glasses frame relative to the housings.

6. Equipment according to claim 1, wherein the power supply unit and signal generating module are connected to the conductors by connector means comprising electrical contacts resiliently biased towards an extended position.

7. Equipment according to claim 6, wherein the resilient biasing is achieved using a pad of an elastomeric material.

* * * * *